US005427237A

United States Patent [19]

Kiefer et al.

[11] Patent Number: 5,427,237

[45] Date of Patent: Jun. 27, 1995

[54] SHIPPING CRATE AND AIR RETURN BULKHEAD FOR A TRANSPORT REFRIGERATION UNIT

[75] Inventors: Kevin W. Kiefer, Prior Lake; Randal W. Gast, Jordan; Robert L. Sirotek, Jr., Apple Valley, all of Minn.

[73] Assignee: Thermo King Corporation, Minneapolis, Minn.

[21] Appl. No.: 74,899

[22] Filed: Jun. 10, 1993

[51] Int. Cl.[6] ..... B65D 85/00

[52] U.S. Cl. ..... 206/320; 206/216

[58] Field of Search ..... 206/216, 320, 572; 220/4.01, 4.28; 29/426.1, 426.2, 428, 462; 53/457, 458, 492

[56] References Cited

U.S. PATENT DOCUMENTS

| | | | |
|---|---|---|---|
| 2,178,213 | 10/1939 | Weiller | 206/320 |
| 3,543,951 | 12/1970 | Marvin | 202/216 |
| 3,891,086 | 6/1975 | Isaacs | 206/320 |
| 3,934,805 | 1/1976 | Elaschuk | 206/320 |
| 4,399,737 | 8/1983 | Severson | 98/6 |
| 4,610,350 | 9/1986 | Johnson et al. | 206/216 |
| 4,996,770 | 3/1991 | McCracken | 29/462 |

FOREIGN PATENT DOCUMENTS

| | | | |
|---|---|---|---|
| 713655 | 9/1966 | Italy | 206/320 |

*Primary Examiner*—Steven N. Meyers
*Assistant Examiner*—Thomas P. Hilliard

[57] ABSTRACT

A dual use kit of structural members, and method of using the kit to perform different functions during shipment and use of a transport refrigeration unit. Structural members of the kit initially form a shipping crate for a transport refrigeration unit, for protecting the transport refrigeration unit during shipment from a manufacturer to a user. The transport refrigeration unit is mounted on the outer surface of a predetermined trailer wall such that the return air plenum extends into a conditioned space defined by the trailer. Structural members of the shipping crate are convertible by the user to form an air return bulkhead adjacent to an inner surface of the predetermined wall of a trailer, to direct trailer air into the return air plenum of the transport refrigeration unit.

7 Claims, 3 Drawing Sheets

SHIPPING CRATE AND AIR RETURN BULKHEAD FOR A TRANSPORT REFRIGERATION UNIT

TECHNICAL FIELD

The invention relates in general to transport refrigeration units, and more specifically to a dual use kit of structural members, and method of using the kit to perform different functions during the shipment and subsequent use of a transport refrigeration unit.

BACKGROUND ART

Transport refrigeration units, such as transport refrigeration units for conditioning the air of a trailer of a tractor-trailer combination, require a shipping crate for shipping each unit to a dealer or user. It is common to construct such shipping crates of wood. Wood, however, in addition to being expensive and wasteful of forest resources, requires additional costly disposal steps after uncrating the transport refrigeration unit. Returnable metal crates have also been used. Metal crates, however, require tracking and they incur the expenses involved in shipping the crates back to the manufacturer for re-use.

It would be desirable, and it is an object of the present invention, to eliminate or minimize the use of wood in the shipping crates of transport refrigeration units, and to make it unnecessary to return at least most of the components of a metal shipping crate. It would also be desirable, and it is another object of the present invention, to construct a shipping crate of components which may be converted by the user of the transport refrigeration unit to perform a function related to the assembly of the transport refrigeration unit on a trailer whose space is to be conditioned by the transport refrigeration unit.

SUMMARY OF THE INVENTION

Briefly, the invention includes a dual use kit of structural members which is used to perform different functions during shipment and subsequent use of a transport refrigeration unit. The kit includes first, second, third and fourth elongated angle members each having first and second right-angled leg portions, and first and second flat sheet or panel members.

The first and second angle members are dimensioned to function as first and second vertical corner members of a shipping crate for a transport refrigeration unit, and also as first and second side members of an air return bulkhead for the transport refrigeration unit. In the air return bulkhead application the first and second angle members are fixed in horizontally spaced, side-by-side vertical orientation to an inner surface of a predetermined wall of a trailer unit.

The third and fourth angle members are dimensioned to function as third and fourth vertical corner members of the shipping crate, and also as first and second intermediate support members of the air return bulkhead. In the air return bulkhead application the third and fourth angle members are fixed to the inner surface of the predetermined trailer wall, between the first and second angle members.

The first and second panel members are dimensioned to function as first and second vertical sides of the shipping crate, and also to collectively function as a bulkhead panel member. In the air return bulkhead application the panel members are aligned in a common vertical plane and fixed to the first, second, third and fourth angle members, in spaced relation with the inner surface of the trailer wall.

In a preferred embodiment of the invention, the first and second leg portions of the first, second, third and fourth angle members have first and second predetermined different width dimensions which are selected to accommodate the two most common trailer wall thickness dimensions. A predetermined one of the first and second leg portions of the first, second, third and fourth angle members is selected for mounting against the inner surface of the trailer wall, with the selection being a function of the thickness dimension of the associated trailer wall.

The invention also includes a method of forming a shipping crate for protecting a transport refrigeration unit during shipment thereof, with the components of the shipping crate being reusable to form an air return bulkhead in the conditioned space of a trailer, adjacent to an inner surface of a predetermined wall of the trailer. The air return bulkhead forms an air chute which directs trailer air to the transport refrigeration unit. The transport refrigeration unit is mounted on the outside surface of the predetermined trailer wall such that a return air plenum of the transport refrigeration unit extends into the conditioned trailer space through an opening in the trailer wall.

The method includes the steps of providing first, second, third and fourth elongated angle members each having first and second right-angled leg portions and longitudinal axes, and providing first and second panel members. The method further includes the steps of dimensioning the first and second angle members to function as first and second vertical corner members of the shipping crate, and as first and second side members of the air return bulkhead, dimensioning the third and fourth angle members to function as third and fourth vertical corner members of the shipping crate and as first and second intermediate support members of the air return bulkhead, and dimensioning the first and second panel members to function as first and second vertical sides of the shipping crate, and to collectively function-as a composite bulkhead panel member.

The method further includes the steps of using the first, second, third and fourth angle members to form vertically oriented corners of a shipping crate, using the first and second panel members to form first and second sides of the shipping crate, mounting a transport refrigeration unit on the shipping crate, shipping the transport refrigeration unit to a user, disassembling the shipping crate, and mounting the transport refrigeration unit on an outer surface of a predetermined wall of a trailer such that an return air plenum of the transport refrigeration unit extends for a predetermined dimension into the trailer through an opening in the predetermined trailer wall.

The method further includes the steps of mounting the first and second angle members in horizontally spaced, side-by-side vertical orientation to an inner surface of the predetermined trailer wall, on opposite sides of the extension of the return air plenum into the trailer, mounting the third and fourth angle members to the inner surface of the predetermined trailer wall, below the extension of the return air plenum and between the first and second angle members, and mounting the first and second panel members in vertically aligned edge-to-edge relation against the first, second, third and fourth angle members to cooperatively form a bulkhead wall in spaced relation with the inner surface of the trailer wall which directs trailer air to flow between the bulkhead wall and inner surface of the trailer wall and into the return air plenum.

BRIEF DESCRIPTION OF THE DRAWINGS

The invention will become more apparent by reading the following detailed description in conjunction with the drawings, which are shown by way of example only, wherein.

DESCRIPTION OF PREFERRED EMBODIMENTS

Figure 1:
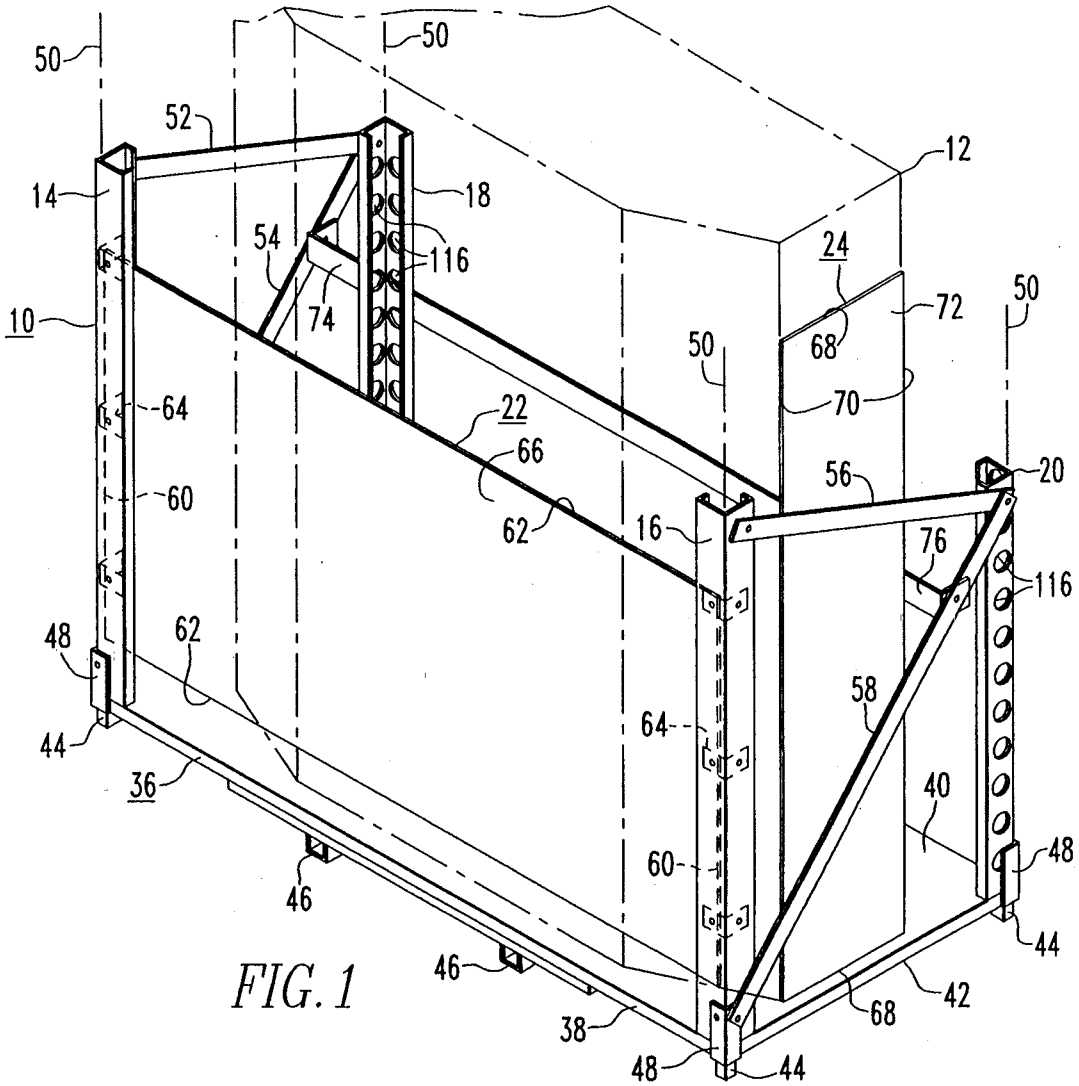
FIG. 1 is a perspective view of a shipping crate for a transport refrigeration unit constructed with a kit and methods of the invention.

Referring now to the drawings, and to FIG. 1 in particular, there is shown a shipping crate 10 which is constructed according to the methods of the invention. Shipping crate 10 supports and protects a transport refrigeration unit 12, shown in phantom in FIG. 1, during shipment of the transport refrigeration unit 12 from a manufacturer to a dealer or user. Shipping crate 10 is constructed using structural components of a kit. The kit, which includes certain structural elements of the shipping crate 10, is shipped to the dealer or user along with the transport refrigeration unit 12.

Elements of the kit which are utilized to construct shipping crate 10 include first, second, third and fourth elongated metallic angle members 14, 16, 18 and 20, respectively, which are preferably formed of aluminum, and first and second rectangularly shaped panel members 22 and 24, respectively, which are preferably formed of a light but strong material, such as a plastic material or plywood.

Figure 2:
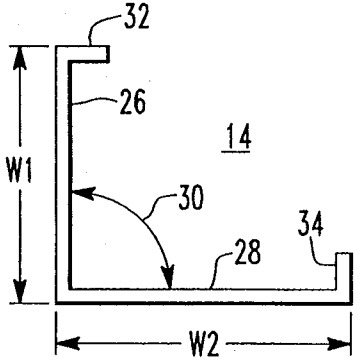
FIG. 2 is an end view illustrating a preferred dimensional relationship between first and second right-angle leg portions of four elongated angle members which are part of the kit, wherein the first and second leg portions are dimensioned to accommodate first and second predetermined thickness dimensions of trailer walls.

Each of the first, second, third and fourth angle members 14, 16, 18 and 20 have first and second right-angled leg portions 26 and 28, respectively, best shown in FIG. 2. FIG. 2 is an end view of the first angle member 14, with end views of the second, third and fourth angle members 16, 18 and 20 being similar. As shown in FIG. 2 the first and second right-angle leg portions of each of the angle members 14, 16, 18 and 20 form a ninety degree angle 30 between them. The first and second leg portions 26 and 28 terminate in right-angle flange portions 32 and 34, respectively, which extend orthogonally outwardly from leg portions 26 and 28, from the same sides which form angle 30. Flange portions 32 and 34 strengthen each angle member and provide flat surfaces utilized in a re-use of the angle members 14, 16, 18 and 20, as will be hereinafter described.

Also as shown in FIG. 2, in a preferred embodiment of the invention, the first and second right-angled leg portions 26 and 28 of the first, second, third and fourth angle members 14, 16, 18 and 20 have first and second different width dimensions W1 and W2, respectively, for purposes which will also be hereinafter described.

Returning to FIG. 1, shipping crate 10 includes a metallic skid assembly 36, preferably formed of steel, with the skid assembly 36 including a rectangularly shaped metallic sheet member 38 having predetermined length, width and thickness dimensions and substantially flat upper and lower surfaces 40 and 42, respectively. Support pads or feet 44 are fixed to the lower surface 42 at the right-angle corners of sheet member 38, skid runners 46 are fixed in spaced relation to the lower surface 40of sheet member 38, and support angle members 48 are fixed to each of the four right-angle corners of sheet member 38 such that they extend perpendicularly upward from the upper flat surface 40 of sheet member 38.

The first, second, third and fourth angle members 14, 16, 18 and 20, which have longitudinal axes 50, are fixed to the support angle members 48 of skid assembly 36 such that their longitudinal axes 50 extend perpendicularly upward from the upper surface 40 of sheet member 38. First, second, third and fourth brace members 52, 54, 56 and 58, respectively, rigidize the upwardly extending angle members 14, 16, 18 and 20.

For example, the first brace member 52 extends between, and is fixed to the uppermost ends of angle members 14 and 18, .and the second brace member 54 extends diagonally from the lowermost end of angle member 14, such as being fixed to the associated support angle member 48, to the uppermost end of angle member 18. The same fastener may be used to fix brace members 52 and 54 to the uppermost end of angle member 18. In like manner, the third brace member 56 extends between, and is fixed to the uppermost ends of angle members 16 and 20, and the fourth brace member 58 extends diagonally from the lowermost end of angle member 16, such as being fixed to the associated support angle member 48, to the uppermost end of angle member 20.

The first panel member 22, which has end and side edges 60 and 62, respectively, extends between, and is fixed to, the first and second upright angle members 14 and 16, such as with a plurality of mounting angle or clip members 64. The first panel member 22 forms a front side of the shipping crate 10, with its major flat surfaces, such as flat surface 66, disposed in vertically oriented planes.

The second panel member 24, which has end and side edges 68 and 70, respectively, is disposed between upright angle members 16 and 20, with an end edge 68 supported by upper surface 40 of sheet member 38. Panel member 24 is fixed to the third and fourth brace members 56 and 58. The second panel member 24, forms a side of the shipping crate 10, with its major flat surfaces, such as flat surface 72, being disposed in vertically oriented planes which are perpendicular to the vertically oriented plane of surface 66 of the first panel member 22.

Transport refrigeration unit 12 is placed on surface 40 of skid assembly 36, and is suitably secured thereto, including mounting brackets 74 and 76 which extend from unit 12 to the diagonal brace members 54 and 58, respectively. Transport refrigeration unit 12, along with its shipping crate 10, is shipped to a dealer or user.

Figure 3:
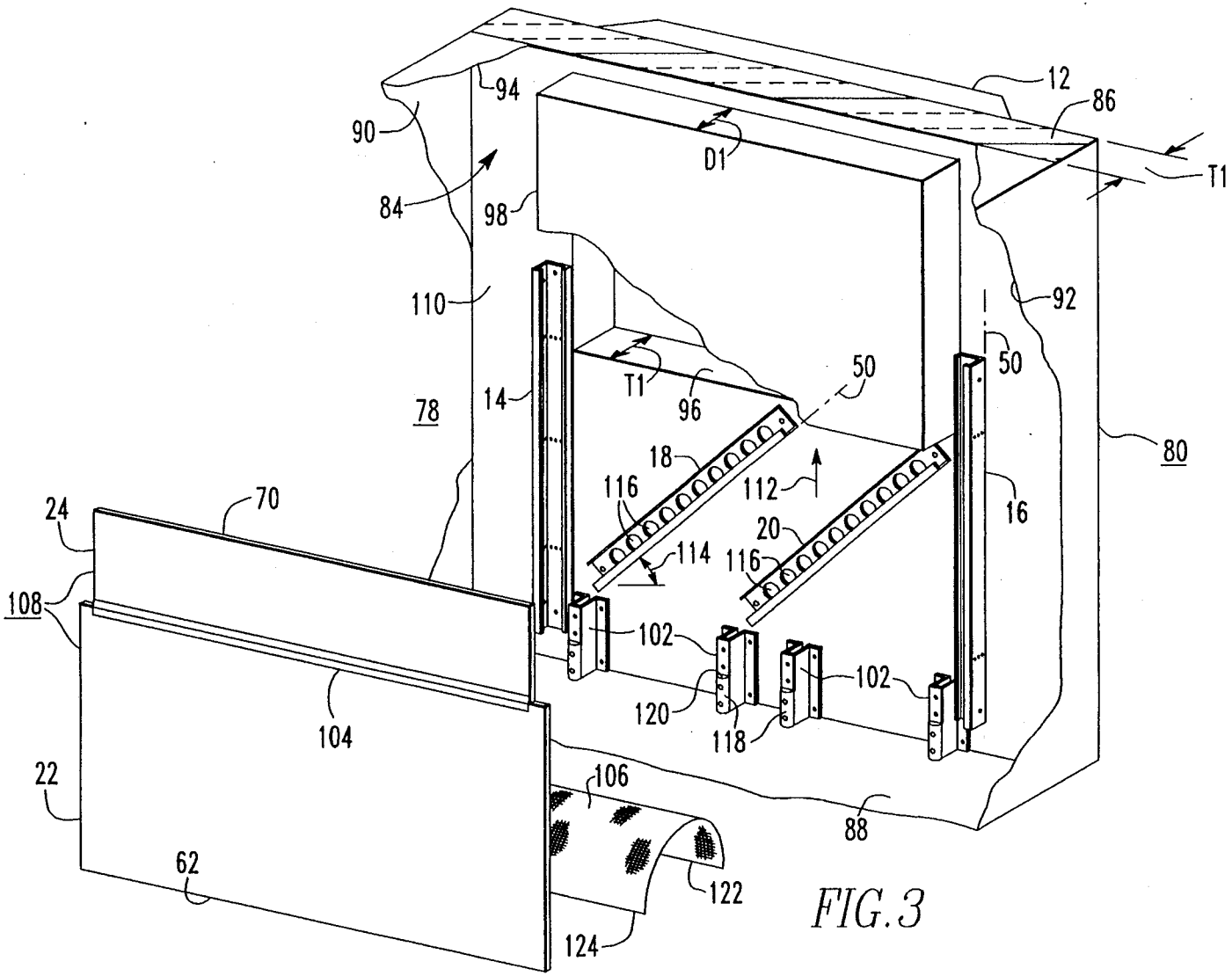
FIG. 3 is a partially exploded perspective view illustrating construction of an air return bulkhead within a conditioned space of a trailer, using components of the kit, including those taken from the shipping crate, and using methods of the invention.
Figure 5:
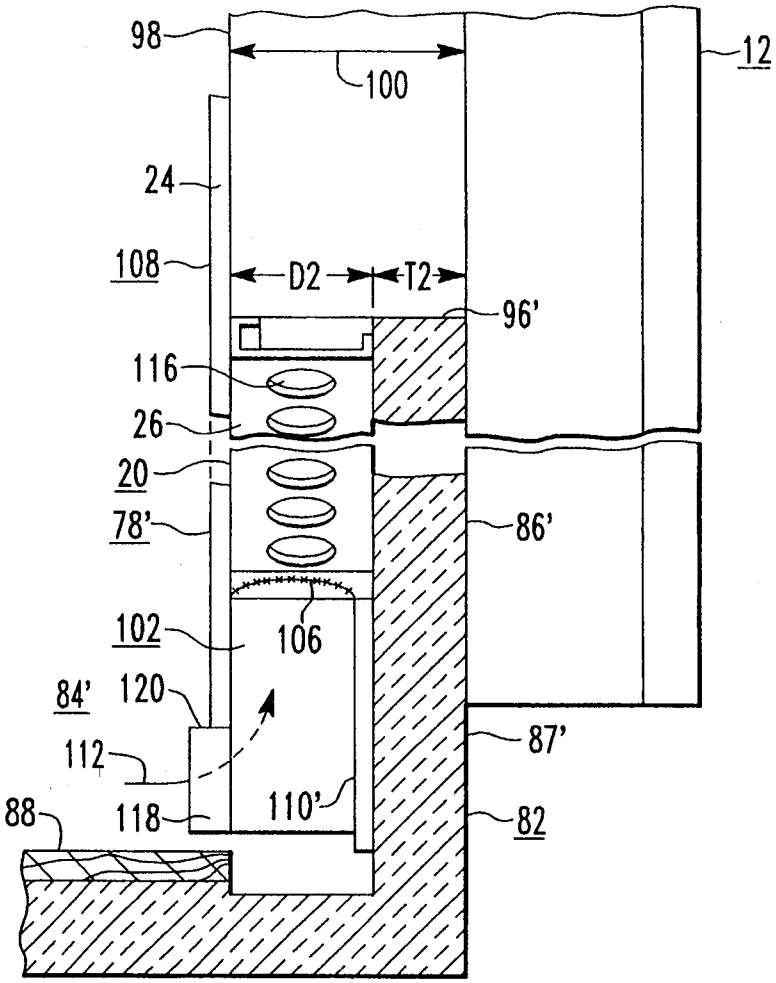
FIG. 5 is a side elevational view, partially in section, illustrating the construction of the air return bulkhead shown in FIG. 3 with a trailer wall having the second predetermined thickness dimension, and with the four elongated angle members having their second leg portions fixed to the inner surface of the trailer wall.
Figure 4:
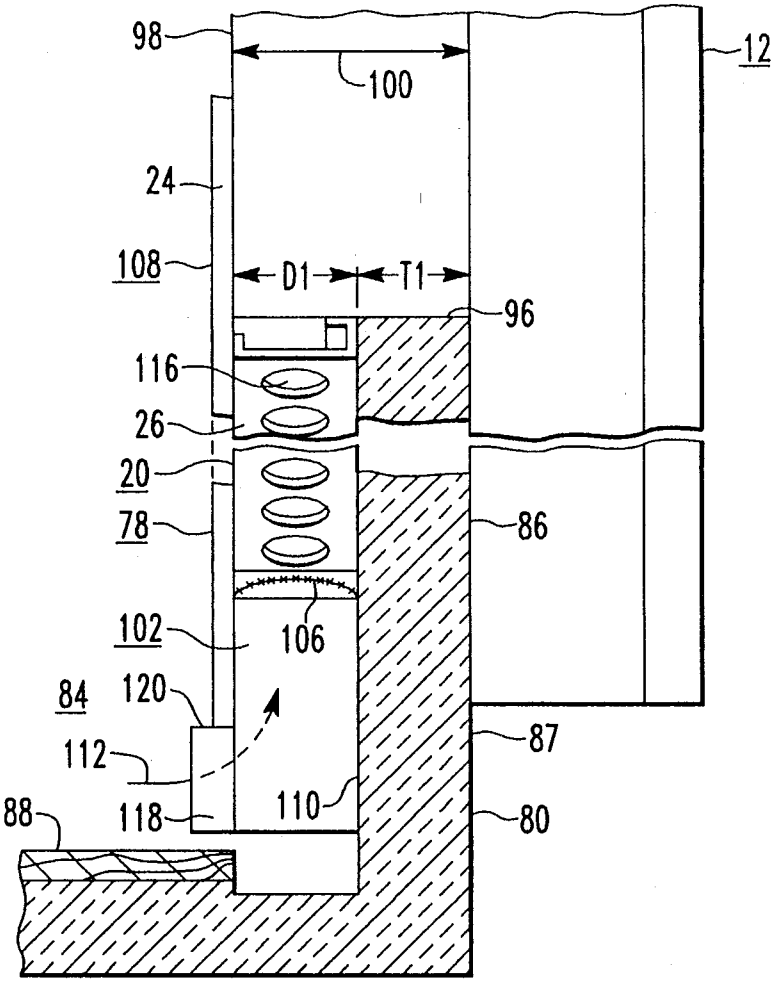
FIG. 4 is a side elevational view, partially in section, illustrating the construction of the air return bulkhead shown in FIG. 3 with a trailer wall having the first predetermined thickness dimension, and with the four elongated angle members having their first leg portions fixed to the inner surface of the trailer wall.

The dealer or user, upon receiving the transport refrigeration unit 12, disassembles the crate 10 and uses the first, second, third and fourth angle members 14, 16, 18 and 20, the first and second panel members 22 and 24, and the remaining elements of a kit which are shipped to the dealer or user along with unit 12, to construct an air return bulkhead 78 shown in FIGS. 3, 4 and 5. FIG. 3 is a partially exploded perspective view of air return bulkhead 78 associated with a trailer 80 having a wall thickness dimension T1. FIG. 4 is a side elevational view, partially in section, of the air return bulkhead 78 shown in FIG. 3. FIG. 5 is a side elevational view, similar to FIG. 4, except illustrating an air return bulkhead 78', which is similar to air return bulkhead 78, except air return bulkhead 78' is illustrated with a trailer 82 which has a wall thickness dimension T2 which is less than the wall thickness dimension T1 of trailer 80. Like reference numbers in FIGS. 4 and 5 indicate like components, and similar but modified elements in FIG. 5 utilize the FIG. 4 reference numbers with the addition of a prime mark.

FIG. 3 illustrates a fragmentary view of a conditioned space 84 defined by trailer 80, including a wall 86 shown partially in section, of trailer 80, with wall 86 having an outer surface 87 upon which transport refrigeration unit 12 is mounted, such as the front wall of trailer 80. Conditioned space 84 is also defined by a floor surface 88, first and second inner side wall surfaces 90 and 92, respectively, and a ceiling surface 94. Wall 86 defines an opening 96 therein, and transport refrigeration unit 12 includes a return air plenum 98 which extends through wall 86 and into conditioned space 84 for a predetermined dimension D1.

The most common front wall thickness dimensions for refrigerated trailers are 4.0 and 3.5 inches (10.2 and 8.9 cm) respectively. It will be assumed for purposes of example that the thickness dimension T1 of the front wall of trailer 80 is the 4.0 inch (10.2 cm) dimension. It will then be assumed that trailer 82 shown in FIG. 5, which has a front wall 86' having the thickness dimension T2, has the 3.5 inch (8.9 cm) dimension. It will be further be assumed that the total depth dimension 100 of the return air plenum 98 of transport refrigeration unit 12 is 8.0 inches (20.3 cm). Thus, the depths of extensions D1 and D2 of return air plenum 98 into conditioned spaces 84 and 84' of trailers 80 and 82 are 4.0 and 4.5 inches (10.2 and 11.4 cm), respectively. With this example, the hereinbefore mentioned width dimensions W1 and W2 of the right angle portions 26 and 28 of each of the right angle members 14, 16, 18 and 20 are 4.0 and 4.5 inches (10.2 and 11.4 cm), respectively.

Returning to FIG. 3, additional elements of the dual purpose kit include a plurality of pallet stop assemblies 102, such as four, an H-shaped channel member 104, a screen member 106, and associated mounting hardware, such as self tapping and/or self drilling screws.

In addition to the steps of assembling shipping crate 10 hereinbefore described, the method of the invention includes a plurality of dimensioning steps, including the step of dimensioning the first and second angle members 14 and 16 such that, in addition to functioning as first and second vertical corner members of shipping crate 10, they will also function as first and second side members of air return bulkhead 78. Another dimensioning step includes the step of dimensioning the third and fourth angle members 18 and 20 such that, in addition to functioning as third and fourth vertical corner members of the shipping crate 10, they will also function as first and second intermediate support members of the air return bulkhead 78. Another dimensioning step includes the step of dimensioning the first and second panel members 22 and 24 such that, in addition to functioning as first and second vertical sides of the shipping crate 10, they may be assembled with the H-shaped channel member 104 to collectively function as a bulkhead panel member 108.

The method further includes the steps of mounting the first, second, third and fourth angle members 14, 16, 18 and 20 against an inner surface 110 of trailer wall 86. Since the thickness dimension T1 of trailer wall 86 was assumed to be 4.0 inches (10.2 cm), the angle members 14, 16, 18 and 20 are all mounted with the wider width dimensioned leg portion 28 against inner surface 110 of wall 86, which extends the narrower width dimensioned leg portion 26 outwardly from inner wall 110 for 4.0 inches (10.2 cm), the exact extension D1 of return air plenum 98 into conditioned space 84.

The first and second angle members 14 and 16, which form first and second side members of return air bulkhead 78, are mounted in horizontally spaced, side-by-side vertical orientation, on opposite sides of the return air plenum 98, such as via self tapping screws disposed through suitable openings in angle members 14 and 16. The lower ends of angle members 14 and 16 start a predetermined dimension above floor surface 88 and the uppermost ends of angle members 14 and 16 extend past the lower edge of return air plenum 98. Return air plenum 98 is open at the bottom, to admit trailer return air, indicated by arrow 112, into return air plenum 98.

The third and fourth angle members 18 and 20, which form first and second intermediate support members of the air return bulkhead 78, have their second right-angle portions 28 mounted against inner surface 110, such as with self tapping screws. A length dimension of angle members 18 and 20 which will satisfy both the shipping crate and return air bulkhead applications of the angle members 18 and 20 will most likely require that angle members 18 and 20 be mounted with the skewed orientation shown in FIG. 3, forming predetermined acute angles 114 between the longitudinal axes 50 of angle members 18 and 20 and a horizontal plane. In order for return air 112 to be returned to return air plenum 98 without obstruction by the skewed orientations of angle members 18 and 20, the right-angle leg portions 26 and 28 of each angle member 18 and 20 are foraminous, i.e., they include a plurality of openings 116.

The next step of the method mounts the pallet stop assemblies 102 against inner surface 110, via appropriate screws, in horizontally spaced relation between the vertically oriented side angle members 14 and 16. They may be mounted on floor surface 88, as illustrated in FIG. 3, or spaced slightly above surface 88 as shown in FIGS. 4 and 5, as desired. Pallet stop assemblies 102 each include a bumper member 118, the upper edge of which forms a support flange 120.

In a preferred embodiment of the invention, the screen member 106 is held in place by pallet stop assemblies 102. In this preferred embodiment screen member 106 is curved or folded over the pallet stop assemblies 102 before they are attached to inner surface 110 such that a selected one of two opposite screen edges 122 or 124, such as edge 122, is secured between the pallet stop assemblies 102 and inner wall surface 110, as shown in FIG. 4.

A next step of the method places a side edge 62 of the first panel member 22 on the support flanges 120 of the pallet stop assemblies 102, and the first panel member 22 is secured to the right-angle flange portion 32 of at least the first and second angle members 14 and 16, such as via self drilling screws. Securing the first panel member 22 to the first and second angle members 14 and 16 traps the remaining folded-over edge 124 of screen member 106 between panel member 22 and the pallet stop assemblies 102, to insure that return air 112 is filtered on its way to the downwardly open entrance of return air plenum 98.

The H-shaped channel member 104 is placed on the uppermost side edge 62 of panel member 22 and a side edge of the second panel member 24 is placed in the H-shaped channel member 104 to complete the composite bulkhead panel member 108. The second panel member 24 is then secured to the flange portions 32 of at least the first and second angle members 14 and 16.

The method of installing air return bulkhead 78' against an inner surface 110' of trailer wall 86' of trailer 82 shown in FIG. 5 is similar to that described relative to trailer 80 in FIGS. 3 and 4 with two modifications. The first modification mounts the first, second, third and fourth angle members 14, 16, 18 and 20 with their first right-angle leg portions 26 against inner surface 110' causing the second right-angle portion 28 to extend outwardly from inner wall 110'. This 4.5 inch (11.4 cm) outward extension of the angle members 14, 16, 18 and 20 exactly matches the 4.5 inch (11.4 cm) extension of return air plenum 98 into conditioned space 78'.

The second modification provides a plurality of 0.5 inch (1.27 cm) thick spacer members 130. Each of the pallet stop assemblies 102 are mounted to inner wall surface 110' using one of the spacer members 130, thus accommodating the extra 0.5 inch (1.27 cm) extension of return air plenum 98 into conditioned space 78'.

We claim:

1. A method of using first, second, third and fourth elongated angle members each having first and second right-angled leg portions and longitudinal axes, and first and second panel members, during shipment of a transport refrigeration unit, and also during subsequent use of the transport refrigeration unit, comprising the steps of:

dimensioning the first and second angle members to function as first and second vertical corner members of a shipping crate for the transport refrigeration unit, and also as first and second side members of an air return bulkhead for the transport refrigeration unit when the transport refrigeration unit is mounted on a wall of a trailer having a space to be conditioned by the transport refrigeration unit, dimensioning the third and fourth angle members to function as third and fourth vertical corner members of the shipping crate, and also as first and second intermediate support members of the air return bulkhead, dimensioning the first and second panel members to function as first and second vertical sides of the shipping crate, and also to collectively function as a single bulkhead panel member of the air return bulkhead, using the first, second, third and fourth angle members to form vertically oriented corners of the shipping crate, including the step of fixing predetermined ends of the first, second, third and fourth angle members to a common support base, using the first and second panel members to form first and second sides of the shipping crate, including the steps of fixing the first panel member to the first and second angle members, and fixing the second panel member to a predetermined one of the first and second angle members and to a predetermined one of the third and fourth angle members, mounting the transport refrigeration unit on the shipping crate, shipping the transport refrigeration unit and shipping crate to a user, disassembling the shipping crate, mounting the transport refrigeration unit on an outer surface of a predetermined wall of the trailer such that a return air plenum of the transport refrigeration unit extends for a predetermined dimension into the trailer through an opening in the predetermined trailer wall, mounting the first and second angle members in horizontally spaced, side-by-side vertical orientation to an inner surface of the predetermined trailer wall, on opposite sides of the extension of the return air plenum into the trailer, mounting the third and fourth angle members to the inner surface of the predetermined trailer wall, between the first and second angle members, and mounting the first and second panel members in vertically aligned edge-to-edge relation against the first, second, third and fourth angle members to cooperatively form the single bulkhead panel member, with the bulkhead panel member forming a bulkhead wall in spaced relation with the inner surface of the predetermined trailer wall which enables trailer air to flow between the bulkhead wall and inner surface of the predetermined trailer wall and into the return air plenum.

2. The method of claim 1 including the step of providing openings in at least the first leg portion of each of the third and fourth angle members, and wherein the step of mounting the third and fourth angle members to the inner surface of the predetermined trailer wall includes the steps of fixing the second leg portions of the third and fourth angle members to the inner surface of the trailer wall, and orienting the third and fourth angle members such that their longitudinal axes form a predetermined acute angle relative to the vertically oriented first and second angle members, whereby air flowing to the return air plenum of the transport refrigeration unit flows through the openings in the first leg portions of the third and fourth angle members.

3. The method of claim 1 wherein the predetermined wall of the trailer has a selected one of first and second predetermined different thickness dimensions, and including the steps of:

providing the first and second leg portions of the first, second, third and fourth angle members with first and second predetermined different width dimensions, with the first and second width dimensions being respectively a function of the first and second predetermined thickness dimensions of the trailer wall, mounting the first leg portions of the first, second, third and fourth angle members against the inner surface of the trailer wall when the trailer wall has the first predetermined thickness dimension, and mounting the second leg portions of the first, second, third and fourth angle members against the inner surface of the trailer wall when the trailer wall has the second predetermined thickness dimension.

4. The method of claim 3 including the step of providing openings in the first and second leg portions of the third and fourth angle members, and wherein the step of mounting the third and fourth angle members on the inner surface of the trailer wall includes the step of orienting the third and fourth angle members such that air flowing to the return air plenum of the transport refrigeration unit flows through the openings in the leg portions of the third and fourth angle members which extend outwardly from the inner surface of the predetermined trailer wall.

5. The method of claim 1 including the step of providing a plurality of pallet stop members each having a like configuration which defines a support flange, fixing the plurality of pallet stop members in spaced relation to the inner surface of the predetermined trailer wall, between the first and second vertically oriented angle members, and wherein the step of mounting the first and second panel members in aligned edge-to-edge relation against the first, second, third and fourth angle members includes the step of placing a lowermost edge of the first panel member on the support flanges of the pallet stop member, and placing an edge of the second panel member against the uppermost edge of the first panel member.

6. The method of claim 5 including the steps of:

providing a screen member, mounting the screen member to extend between the inner surface of the predetermined wall of the trailer unit and a predetermined one of the first and second panel members, such that air entering the air return bulkhead flows through the screen member.

7. The method of claim 6 wherein the step of mounting the screen member includes the steps of folding the screen member over the plurality of pallet stop members prior to the step of mounting the pallet stop members, to secure the screen member between the pallet stop members and the inner surface of the predetermined trailer wall, and between the pallet stop members and the first panel member.

* * * * *